United States Patent [19]

Strauss

[11] Patent Number: 4,804,881

[45] Date of Patent: Feb. 14, 1989

[54] CORNER CONNECTORS FOR SHADOW MASK SUPPORT STRUCTURE

[75] Inventor: Paul Strauss, Chicago, Ill.

[73] Assignee: Zenith Electronics Corporation, Glenview, Ill.

[21] Appl. No.: 137,492

[22] Filed: Dec. 23, 1987

[51] Int. Cl.[4] ..... H01J 29/07

[52] U.S. Cl. ..... 313/407; 313/408; 313/482

[58] Field of Search ..... 313/407, 482, 408, 402

[56] References Cited

U.S. PATENT DOCUMENTS

| | | | |
|---|---|---|---|
| 2,625,734 | 1/1953 | Law . | |
| 2,842,696 | 7/1958 | Fischer-Colbrie . | |
| 2,905,845 | 9/1959 | Vincent . | |
| 3,030,536 | 4/1962 | Hackett et al. . | |
| 3,284,655 | 11/1966 | Oess . | |
| 3,638,063 | 1/1972 | Tachikawa et al. . | |
| 3,727,087 | 4/1973 | Steinberg et al. . | |
| 3,894,321 | 7/1978 | Moore . | |
| 4,045,701 | 8/1977 | Dougherty . | |
| 4,069,567 | 1/1978 | Schwartz . | |
| 4,087,717 | 5/1978 | Lerner . | |
| 4,100,451 | 7/1978 | Palac . | |
| 4,547,696 | 10/1985 | Strauss . | |
| 4,725,756 | 2/1988 | Kaplan | 313/407 |

FOREIGN PATENT DOCUMENTS

| | | | |
|---|---|---|---|
| 3521031 | 12/1986 | Fed. Rep. of Germany | 313/407 |

OTHER PUBLICATIONS

"The CBS Colortron: A Color Picture Tube of Advanced Design", Fyler et al. Proc. of the IRE, Jan. 1954 Dec. class R 583.6.

"A High Brightness Shadow Mask Color CRT for Cockpit Display", Robinder, et al. Society for Information Display, 1983.

*Primary Examiner*—Palmer C. DeMeo

[57] ABSTRACT

An improved front assembly for a color cathode ray tube having a tension foil shadow mask is disclosed. The faceplate of the tube has on its inner surface a centrally disposed phosphor screen surrounded by a peripheral sealing area adapted to mate with a funnel. The assembly includes a shadow mask support structure for securing a shadow mask in tension on the structure and for spacing the shadow mask from the screen. The support structure is comprised of an assembly including a plurality of elongated members that substantially surround the centrally disposed phosphor screen and meet at corner areas of the screen. The elongated members having open ends. The support structure also includes corner connector members having reduced end or plug portions projecting into the open ends of adjacent ones of the elongated members at the corner areas of the screen. The plug portions are sized and shaped to provide a snug fit with the open ends of the adjacent elongated members and are secured and sealed thereto. The aforesaid snug fit provides a fixturing for the corner connectors and the elongated members to facilitate the securing and sealing processes of the assembly. The corner connector members, except for the plug portions, are sized and shaped to form a continuation of the cross-sectional configuration of the elongated members.

22 Claims, 4 Drawing Sheets

CORNER CONNECTORS FOR SHADOW MASK SUPPORT STRUCTURE

CROSS-REFERENCE TO RELATED APPLICATIONS

This application is related to but in no way dependent upon copending applications Ser. No. 832,493, filed Feb. 21, 1986; Ser. No. 831,699, filed Feb. 21, 1986 now U.S. Patent No. 4,686,416; Ser. No. 832,556, filed Feb. 21, 1986; Ser. No. 835,845, filed Mar. 3, 1986, now U.S. Pat. No. 4,725,756; Ser. No. 866,030, filed May 21, 1986; Ser. No. 942,663, filed Dec. 17, 1986; Ser. No. 925,656, filed Oct. 29, 1986; Ser. No. 923,934, filed Oct. 28, 1986; Ser. No. 942,336, filed Dec. 16, 1986; and Ser. No. 925,345, filed Oct. 31, 1986; all of common ownership herewith.

FIELD OF THE INVENTION

This invention generally relates to color cathode ray picture tubes and, specifically, to a novel front assembly for color tubes that have a tension foil shadow mask. The invention is useful in color tubes of various types including those used in home entertainment television receivers, and those used in medium-resolution and high-resolution tubes intended for color monitors.

BACKGROUND OF THE INVENTION

The use of the tension foil mask and a flat faceplate provides many advantages and benefits in comparison with the conventional curved or domed shadow mask. Chief among these is a greater power-handling capability which makes possible as much as a three-fold increase in brightness. The conventional curved shadow mask, which is not under tension, tends to "dome" in high-brightness picture areas where the intensity of electron bombardment is greatest. Color impurities result as the mask moves closer to the faceplate. Being under high tension, the tension foil mask does not dome or otherwise move in relation to the faceplate. Therefore, it has greater brightness potential while maintaining color purity.

The tension foil shadow mask is a part of the cathode ray tube front assembly, and is located in close adjacency to the faceplate. The front assembly comprises the faceplate with its deposits of light-emitting phosphors, a shadow mask, and support means for the mask. As used herein, the term "shadow mask" means an apertured metallic foil which may have a thickness, by way of example, of about one mil or less. The mask must be supported in high tension a predetermined distance from the inner surface of the cathode ray tube faceplate. This distance is known as the "Q-distance". The high tension may be in the range of 10 to 40 kpsi. As is well known in the art, the shadow mask acts as a color-selection electrode, or parallax barrier, which ensures that each of the three color beams lands only on its assigned phosphor deposits.

The requirement for the support means for the shadow mask are stringent. As has been noted, the shadow mask must be mounted under high tension. The mask support means must be of high strength so that the mask is held immovable. An inward movement of the mask of as little as one-tenth of a mil is significant in that guard band may be expended. Also, the shadow mask support means must be of such configuration and material composition as to be compatible with the means to which it is attached. As an example, if the support means is attached to glass such as the inner surface of the faceplate, the support means must have about the same thermal coefficient of expansion as that of the glass. The support means must provide a suitable surface for mounting the mask. Also, the shadow mask support means must be of such configuration and material composition as to be compatible with the means to which it is attached. As an example, if the support means is attached to glass such as the inner surface of the faceplate, the support means must have about the same thermal coefficient of expansion as that of the glass. The support means must provide a suitable surface for mounting the mask. Also, the support means must be of a composition such that the mask can be welded onto it by electrical resistance welding or by laser welding. The support surface preferably is of such flatness that no voids can exist between the metal of the mask and the support structure to prevent the intimate metal-to-metal contact required for proper welding.

A tension mask registration and supporting system is disclosed by Strauss in U.S. Pat. No. 4,547,696 of common ownership herewith. A frame dimensioned to enclose the screen comprises first and second spaced apart surfaces. A tensed foil shadow mask has a peripheral portion bonded to a second surface of the frame. The frame is registered with the faceplate by ball-and-groove indexing means. The shadow mask is sandwiched between the frame and a stabilizing or stiffening member. When the system is assembled, the frame is located between the sealing lands of the faceplate and funnel, with the stiffening member projecting from the frame into the funnel. While the system is feasible and provides an effective means for holding a mask under high tension and rigidly planoparallel with a flat faceplate, weight is added to the cathode ray tube, and additional process steps are required in manufacture.

There exists in the marketplace today a color tube that utilizes a tensed shadow mask. The mask is understood to be placed under high tension by purely mechanical means. Specifically, a very heavy mask support frame is compressed prior to and during affixation of the mask to it. Upon release of the frame, restorative forces in the frame cause the mask to be placed under high residual tension. During normal tube operation, electron beam bombardment causes the mask to heat up and the mask tension to be reduced. An upper limit is placed on the intensity of the electron beams that may be used to bombard the screen without causing the mask to relax completely and lose its color selection capability. The upper limit has been found to be below that required to produce color pictures of the same brightness as are produced in tubes having non-tensed shadow masks. For descriptions of examples of this type of tube, see U.S. Pat. No. 3,683,063 to Tachikawa.

Other prior art include: Lerner—U.S. Pat. No. 4,087,717; Dougherty—U.S. Pat. No. 4,045,701; Palac—U.S. Pat. No. 4,100,451; Law—U.S. Pat. No. 2,625,734; Steinbert et al—U.S. Pat. No. 3,727,087; Schwartz—U.S. Pat. No. 4,069,567; Moore—U.S. Pat. No. 3,894,321; Oess—U.S. Pat. No. 3,284,655; Hacket—U.S. Pat. No. 3,303,536; Hacket et al—U.S. Pat. No. 3,030,536; Vincent—U.S. Pat. No. 2,905,845; Fischer-Colbrie—U.S. Pat. No. 2,842,696; Law—U.S. Pat. No. 2,625,734; a journal article: "The CBS Colortron: A color picture tube of advanced design". Fyler et al. Proc. of the IRE, Jan. 1954. Dec. class $583.6; and a digest article: "A High-Brightness Shadow-Mask Color CRT for cockpit Display". Robinder et al. Society for Information display, 1983.

OBJECTS OF THE INVENTION

A general object of the invention is to provide an improved front assembly for tension foil shadow mask tubes.

Another general object of the invention is to provide a tension foil shadow mask support structure that is low in cost and light in weight.

A further object of the invention is to provide a tension foil shadow mask support structure that can be mounted on a faceplate for receiving a tension foil shadow mask.

It is an object of the invention to provide a shadow mask support structure which permits use of minimal diagonal panel dimensions for a given screen size.

It is also an object of the invention to provide a cored shadow mask support structure for a cathode ray tube wherein any voids present in the core material do not present potential outgassing problems during tube processing or operation.

Still another object of the invention is to provide a tension foil shadow mask support structure that is capable of holding a tension foil shadow mask firmly in registration under high electron beam bombardment.

Yet a further object of the invention is to provide a tension foil shadow mask support structure that simplifies manufacture and lowers manufacturing costs.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings, in the figures of which like reference numerals identify like elements, and in which:

DESCRIPTION OF THE EMBODIMENT

Figure 1:
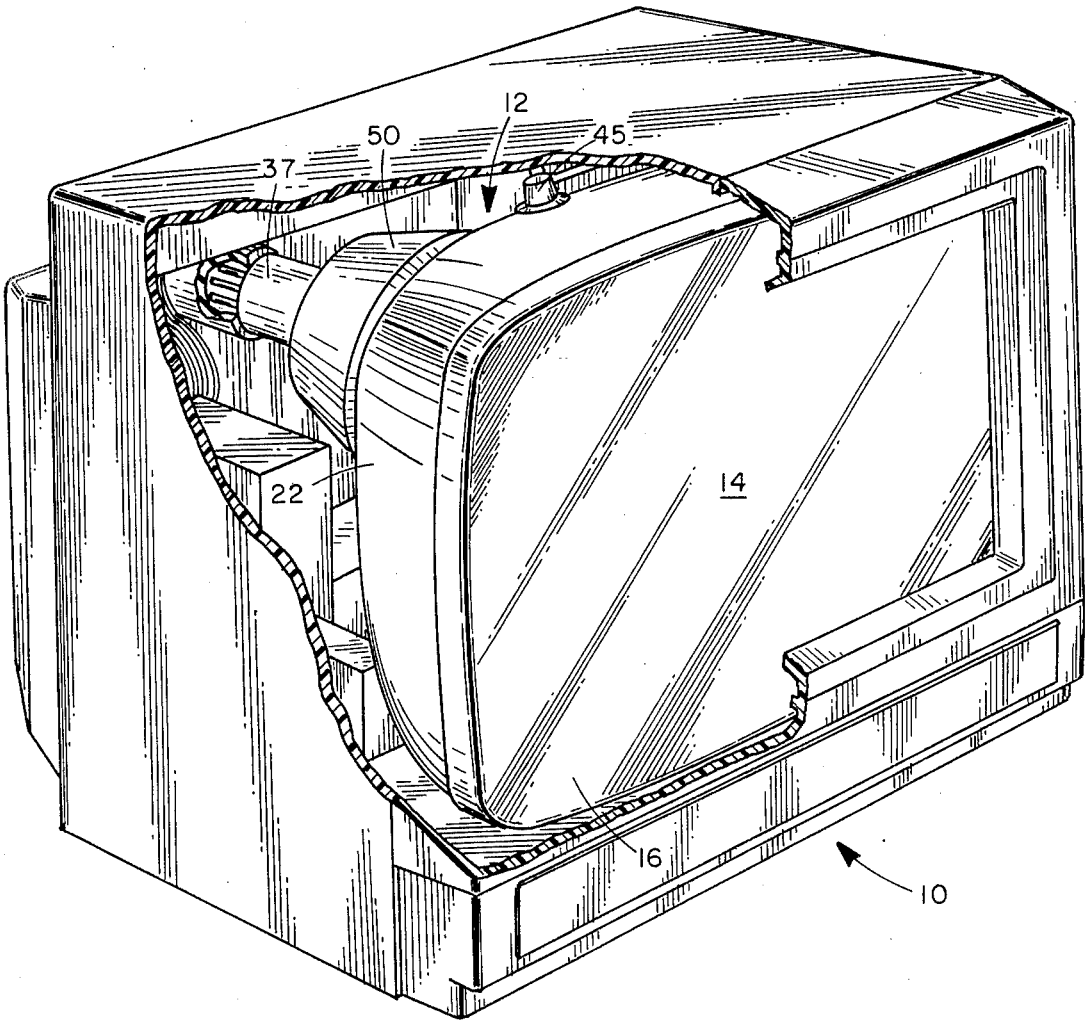
FIG. 1 is a cut-away perspective view of a cabinet housing a cathode ray tube having a front assembly according to the invention.

FIG. 1 depicts a video monitor, generally designated 10, that houses a color cathode ray tube, generally designated 12, having a novel front assembly according to the invention. The design of the video monitor is the subject of copending design patent application Ser. No. 725,040 of common ownership herewith. The monitor-associated tube is notable for the flat imaging area 14 that makes possible the display of images in undistorted form. Imaging area 14 also offers a more efficient use of screen area as the corners are relatively square in comparison with the more rounded corners of the conventional cathode ray tube. The front assembly according to the invention comprises the components described in the following paragraphs.

Figure 2:
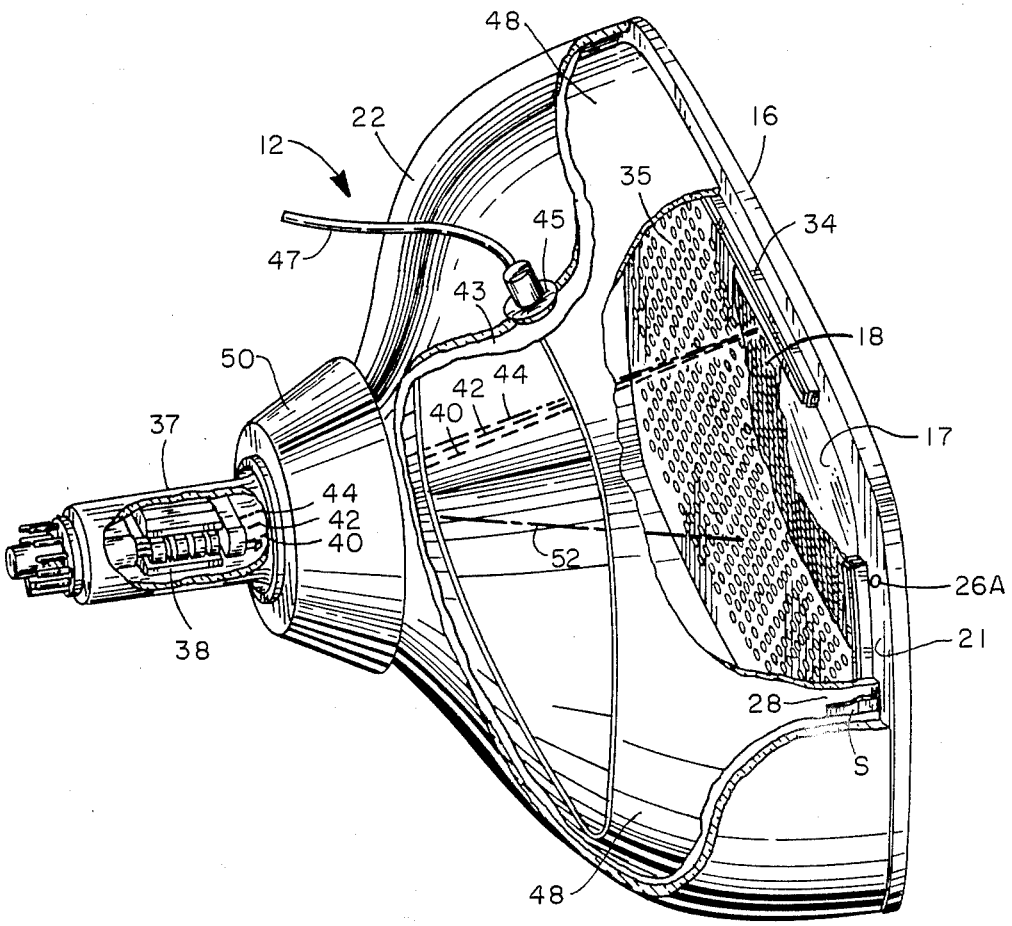
FIG. 2 is a cut-away side perspective view of the color cathode ray tube of FIG. 1, illustrating the location of the shadow mask support structure incorporating the concepts of the invention.
Figure 3:
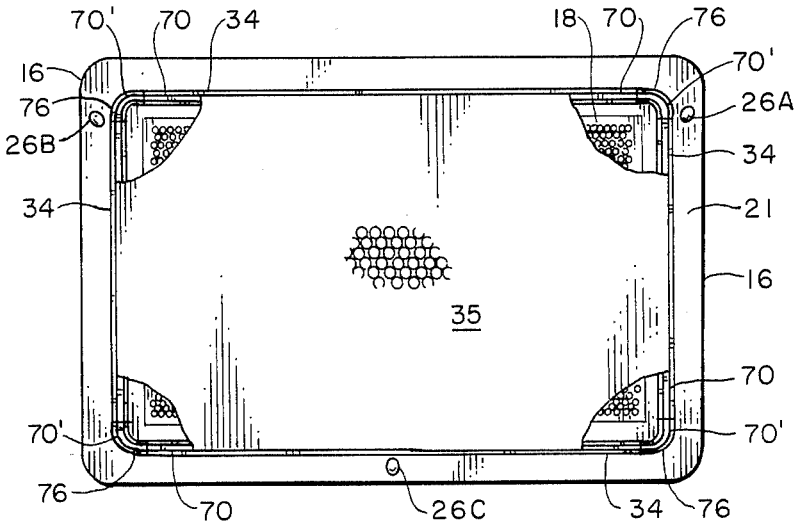
FIG. 3 is a plan view showing the relationship of the shadow mask support structure to the inner surface of the cathode ray tube faceplate shown in FIG. 2.
Figure 4:
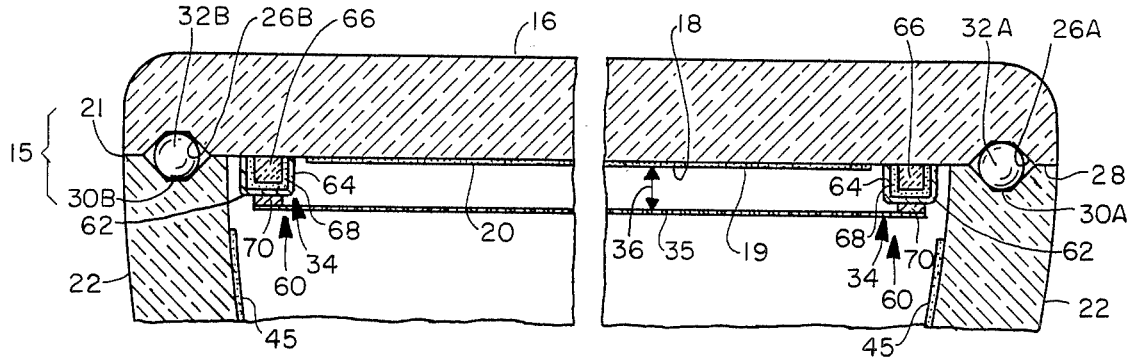
FIG. 4 is a sectional view taken through the front assembly generally on a normal through the central axis of the cathode ray tube, and illustrating an embodiment of a tension shadow mask support structure.

With reference also to FIGS. 2, 3 and 4, a front assembly 15 (FIG. 4) for a high-resolution color cathode ray tube is depicted, the general scope of which is indicated by the bracket. Front assembly 15 includes a glass faceplate 16 noted as being flat, or alternately, "substantially" flat in that it may have finite horizontal and vertical radii. Faceplate 16, depicted in this embodiment of the invention as being planar and flangeless, has on its inner surface a centrally disposed target area upon which a pattern 18 of elemental different colored light emitting phosphor deposits is disposed. An electrically conductive film 19 is deposited over the phosphor pattern 18 to form, in conjunction with the phosphor pattern, the electron beam target, commonly designated a "screen" 20. The aforesaid conductive film typically consists of a very thin, light-reflective, electronpervious coating of aluminum.

Screen 20 is surrounded by a peripheral sealing area 21 adapted to be mated to the sealing land area of a funnel 22. Sealing area 21 is represented as having three substantially radially oriented first indexing V-groves 26A, 26B and 26C therein, see FIG. 3, with only grooves 26A and 26B being shown in FIG. 4. The indexing grooves preferably are peripherally located at equal angular intervals about the center of faceplate 16; that is, at 120-degree intervals. The V-shaped indexing grooves provide for indexing faceplate 16 to a mating envelope member, as will be shown.

As shown in FIG. 4, the sealing area 28 of funnel 22 is provided with second indexing elements or grooves, only two of which, 30A and 30B, are depicted. As illustrated, grooves 30A and 30B are disposed in facing adjacency with the first indexing elements 26A and 26B. Ball means 32A and 32B, comprising rounded indexing means, are conjugate with the indexing grooves or elements 26A and 26B and 30A and 30B for registering the faceplate 16 and the funnel 22. The first indexing elements together with the ball means are also utilized as indexing means during the photoscreening of the phosphor deposits on the faceplate. It is to be appreciated that the above-described faceplate/funnel indexing arrangement is but one of a multitude of indexing schemes available for registering a faceplate and a funnel.

Front assembly 15 according to the invention includes a tension foil mask support structure, generally designated 34, secured to the inner surface of faceplate 16 between screen 20 and peripheral sealing area 21. The support structure provides for supporting a planar tension foil shadow mask 35 a predetermined "Q-distance" from the inner surface of faceplate 16. This "Q-distance" is indicated by the double-pointed arrow 36 in FIG. 4.

As seen in FIG. 2, a neck 37 extending from funnel 22 is represented as housing an electron gun 38 which is indicated as emitting three electron beams 40, 42 and 44 that selectively activate screen 20, above noted as comprising colored-light emitting phosphor deposits overlayed with a conductive film. Beams 40, 42 and 44 serve to selectively activate the pattern 18 of phosphor deposits after passing through the parallax barrier formed by shadow mask 35.

Funnel 22 is indicated as having an internal electrically conductive funnel coating 43 adapted to receive a high electrical potential. The potential is applied through an anode button 45 attached to a conductor 47 which is connected to a high electrical potential. The source of the potential is a highvoltage power supply (not shown). The potential may be, for example, in the range of 18 to 26 kilovolts for the disclosed monitor application. Means for providing an electrical connection between the electrically conductive support structure 34 and funnel coating 43 may comprise spring means "S" (depicted in FIG. 2).

A magnetically permeable internal magnetic shield 48 is shown as being attached to support structure 34. Shield 48 extends into funnel 22 a predetermined distance which is calculated so that there is no interference with the excursion of the sweeping electron beams 40, 42 and 44, yet maximum shielding is provided.

A yoke 50 is shown as encircling tube neck 37 in the region of the junction between funnel 22 and the neck. Yoke 50 provides for the electromagnetic scanning of beams 40, 42 and 44 across the screen 20. The center axis of tube 12 is indicated by the broken line 52.

Figure 5:
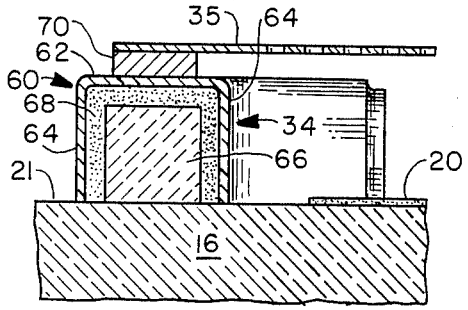
FIG. 5 is a fragmented sectional view through the tension shadow mask support structure of FIG. 4, on an enlarged scale and inverted in relation to that shown in FIG. 4.
Figure 6:
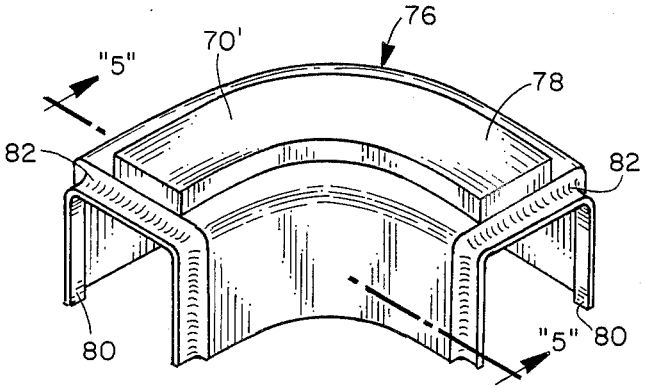
FIG. 6, is a perspective view of a corner connector member embodying the concepts of the invention, for use with the shadow mask support structure of FIGS. 1-5.

Referring now to FIG. 5, in conjunction with the previously described drawings, this form of the support structure 34 provides means for securing shadow mask 35 in tension on the structure and for spacing the shadow mask from screen 20. More particularly, support structure 34 comprises a support assembly including an inverted channel-shaped member, generally designated 60, fabricated of thin metal material and having a crossover 62 that bridges a pair of depending leg portions 64. Portion 62 defines a flattened sill to facilitate securing the shadow mask to the support structure. A stiffening core 66 of a generally rectangular cross-sectional shape and of a length less than the length of channel member 60, for a purpose to be explained, is secured within channel member 60 between leg portions 64. Stiffening core 66 is spaced from the inside surfaces of cross portion 64 and leg portions 66, and filling material such as a hardened cement 68 is employed to substantially fill that space. As shown in FIG. 5, a rigid metal bar 70 is welded or brazed to the top surface of crossover 62 of the channel-shaped member to receive and secure, as by welding the periphery of shadow mask 35. A curved section 70' of bar 70 facilitates continuing the support structure around the corners of the shadow mask, as seen in FIGS. 3 and 6. Further details of support structure 34 are shown in copending application Ser. No. 942,336, filed Dec. 16, 1986.

In order to appreciate the advantages of the invention, it should be noted that proper operation of a cathode ray tube requires excellent vacuum with residual gas pressure in the order of $10^{-8}$ Torr, or less. It is extremely important to avoid contamination of the electron emitting cathode by foreign substances such as air or moisture. Such contaminants "poison" the cathode and inhibit its emitting function. Furthermore, it should be understood that the hardened cement 68 (FIGS. 4 and 5) may, for example, be a devitrifying glass frit well-known in the art, or a cold-setting cement such as Sauereisen-type cement. Such materials as frit, or the like, are used in all of the embodiments of support structures shown herein for either stiffening the support structures or for securing the support structures to faceplate 16. Such cement materials, after hardening, may include voids containing air or moisture. With the high vacuum of the cathode ray tube, it can be understood that any voids in the structure of the shadow mask support structure could, by virtue of the contaminant included in the void, cause an outgassing problem during the life of the tube. The problem, of course, is exacerbated because of the high vacuum in the tube. The outgassing problem is prone to occur at the ends of the elongated support structure components 60 which meet at the corners of phosphor screen 20, as exemplified in FIG. 3. This is particularly true when the elongated support structures 34 which extend along the lineal sides of the screen are hollow and contain a hardened cement such as frit 68, see FIGS. 4 and 5. The invention is directed to solving such problems as well as providing a continuous support structure for shadow mask 35 along the lineal sides as well as around the corners of the phosphor screen.

More particularly, and referring to FIG. 6 in conjunction with FIG. 3, the invention contemplates an elbow-shaped right-angled corner connector member, generally designated 76, to provide a continuation of lineal support components 60 around the corners of the phosphor screen. Corner connector member 76 includes a body portion 78 which has outside cross-sectional dimensions substantially identical to the outside dimensions of inverted channel-shaped member 60 (FIGS. 4 and 5). One such corner connector member is provided at each of the four corners of the phosphor screen and shadow mask as shown in FIG. 3. Each corner connector member 76 includes reduced end sections 80, hereinafter designated plug portions, which are dimensioned to fit snugly inside of confronting inverted channel-shaped components 60. Preferably, weld or brazing means are employed to join the plug portions 80 of the corner connector members to the open ends of the inverted channel-shaped shadow mask support structure in order to secure and seal the corner connector members to their associated elongated support structures. In this regard, the shoulders 82 formed at the juncture of plug portions 80 and the body portion 78 are firmly abutted against the open ends of the adjacent inverted channel-shaped support structures 60 to provide the requsite secure seal. Additionally this cooperation of plug portions and open ends serves to provide fixturing of the support structure assembly during the welding or brazing process.

Therefore, it can be seen that the ends of the elongated support structures, at the corners of the phosphor screen, are now completely sealed off to prevent any outgassing from the interior of the support structure during the life of the cathode ray tube. In the same fashion as the elongated support structures 34 are anchored, the corner connector members 76 are secured to faceplate 16 by an appropriate cement.

The corner connector members 76 also serve the additional function of providing a continuing support of shadow mask 35 around the corners of the phosphor screen. Specifically, and with respect to the support structure assembly of FIGS. 3–6, it can be seen (FIG. 6) that with curved corner sections 70' of rigid bar 70 disposed atop corner connectors 76 and welded thereto, a continuous planar surface is provided around the periphery of the phosphor screen to which shadow mask 35 can be welded or brazed. It should also be appreciated that, even in the absence of separate support components such as rigid bars 70, 70', the assemblage of components 60 and 76 itself provides a continuous surface to which the shadow mask can be welded.

Figure 7:
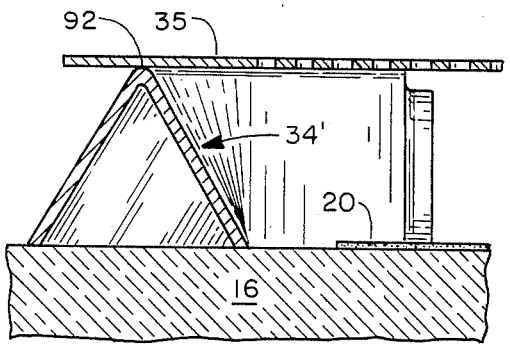
FIG. 7 is another form of the shadow mask support structure.
Figure 9:
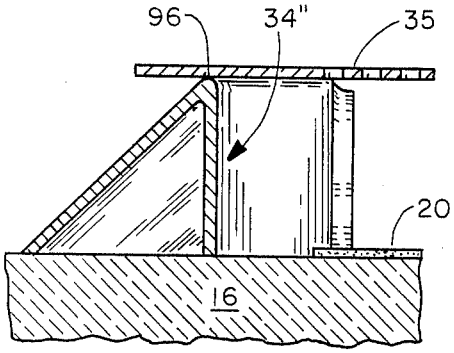
FIG. 9 is a further form of shadow mask support structure.
Figure 11:
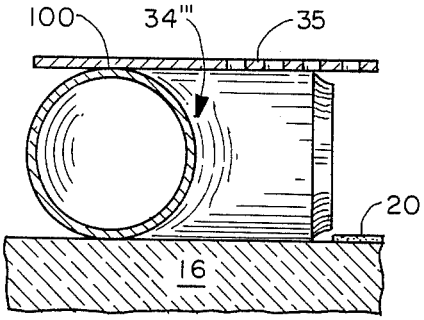
FIG. 11 is still another form of shadow mask support structure.

FIGS. 7, 9 and 11 show various other forms of support structures secured to faceplate 16 about phosphor screen 20 for supporting tension shadow mask 35. FIG. 7 shows a shadow mask support structure, generally designated 34' configured in the form of an equilateral triangle. FIG. 9 shows a shadow mask support structure 34'' having a right-angular configuration. In this embodiment it is to be appreciated that if desired, the sloping leg of structure 34'' could reversed, that is, be directed in toward screen 20. Finally, FIG. 11 shows a shadow mask support 34''' of a circular configuration. Each of the support structures 34', 34'' and 34''' comprise elongated support members extending along the lineal sides of the phosphor screen, similar to support structures 34 shown in FIG. 3.

Figure 8:
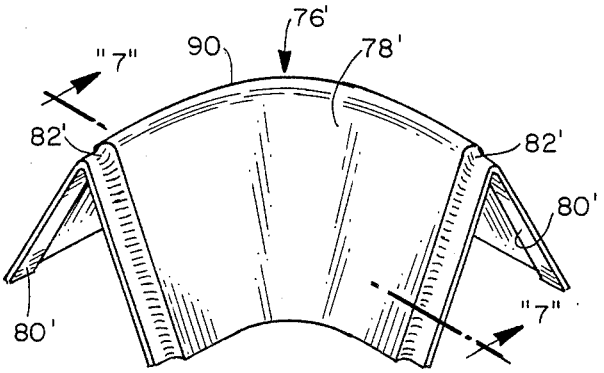
FIG. 8 is a perspective view of a corner connector embodying the concepts of the invention for use with the shadow mask support structure of FIG. 7.
Figure 10:
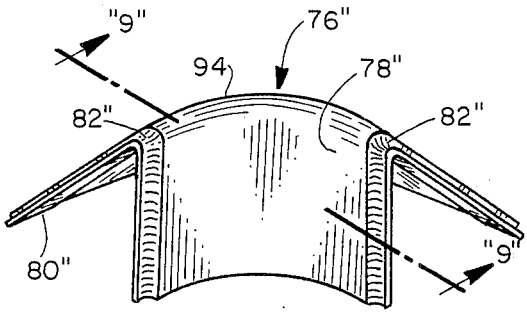
FIG. 10 is a perspective view of a corner connector member embodying the concepts of the invention, for use with the shadow mask support structure of FIG. 9.
Figure 12:
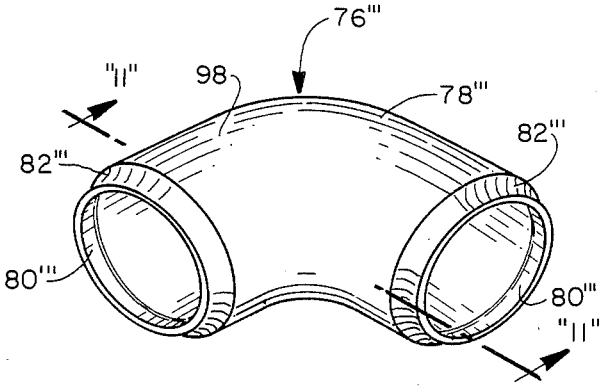
FIG. 12 is a perspective view of a corner connector member embodying the concepts of the invention, for use with the shadow mask support structure of FIG. 11.

Appropriately configured corner connector members are shown in FIGS. 8, 10 and 12 for use respectively with the shadow mask support structures 34', 34'' and 34''' shown in FIGS. 7, 9 and 11. More particularly, FIG. 8 shows a corner connector member 76' having a triangular configuration comprising an elbow-shaped body portion 78' and reduced end plug portions 80'. Plug portions 80' of connectors 76 fit snugly into the ends of adjacent shadow mask support structures 34' (FIG. 7) at each corner of the phosphor screen.

Similarly, FIG. 10 shows a right triangle-shaped corner connector member 76'', comprising an elbow-shaped body portion 78'' and reduced end plug portions 80''. The plug portions 80'' are configured to fit snugly into adjacent open ends of support structures 34'' (FIG. 9) at each of the four corners of the screen.

FIG. 12 shows a corner connector member 76''' having a cylindrical configuration and comprising an elbow-shaped body portion 78''' and reduced end plug portions 80'''. Plug portions 80''' are sized and shaped to fit snugly into the circular ends of shadow mask support structures 34''' (FIG. 11).

In each of the embodiments of corner connector members 76', 76'' and 76''' (FIGS. 8,10 and 12) respective shoulders 82', 82'' and 82''' are provided for abutment with the ends of shadow mask support structures 34', 34'' and 34''', to provide the secure seal and fixturing functions provided by shoulder 80 described above in connection with connector member 76, FIG. 6.

As with corner connector member 76, corner connector members 76', 76'' and 76''' are designed not only to seal the ends of the shadow mask support structures after appropriate joining processes such as welding or brazing, but to provide a continuation of the support for the shadow mask around the corners of the phosphor screen. Specifically, corner connector member 76' (FIG. 8) has a curved top ridge 90 which will form a continuation of ridge 92 (FIG. 7) of the adjacent, lineal support structures 34'. Similarly, corner connector member 76'' (FIG. 10) has a curved ridge 94 which will form a continuation of ridge 96 (FIG. 9) of support structures 34''. Lastly, corner connector member 76''' (FIG. 12) has a top ridge 98 which will form a continuation of ridge 100 (FIG. 11) of support structures 34'''. As a result, in each of the aforesaid three embodiments (FIGS. 7–12)) the mask 35 will be supported completely around the periphery of screen 20.

While particular embodiments of the invention have been shown and described, it will be readily apparent to those skilled in the art that changes and modifications may be made in the inventive means and method without departing from the invention in its broader aspects, and therefore, the aim of the appended claims is to cover all such changes and modifications as fall within the true spirit and scope of the invention.

What is claimed is:

1. A front assembly for a color cathode ray tube including a faceplate having on its inner surface a centrally disposed phosphor screen surrounded by a peripheral area adapted to mate with a funnel, said assembly including a shadow mask support structure for securing a shadow mask in tension on the structure and spacing said shadow mask from said screen said support structure comprising a support assembly including a plurality of elongated members substantially surrounding the centrally disposed phosphor screen and meeting at corner areas of the screen, said elongated members having at least partially open matable end portions, and connector members disposed in said corners and having complementary matable portions matable with said end portions of adjacent ones of said elongated members at said corner areas of said screen, said matable portions of each said corner connector member being configured as plug portions and sized to provide a snug sealing fit with said open end portions of adjacent ones of said elongated members so as to provide fixturing for the securing and sealing processes of said assembly.

2. The front assembly of claim 1, including weld or braze means for securing and sealing said corner connector members to adjacent ones of said elongated members.

3. the front assembly of claim 2 wherein said weld or braze means are located between said plug portions of said corner connector members and said open ends of said elongated members.

4. The front assembly of claim 1 wherein said corner connector members, except for said matable portions thereof, are sized and shaped to form a continuation of the cross-sectional configuration of said elongated members.

5. The front assembly of claim 4 wherein said elongated members and said corner connector members are triangular in cross-section.

6. The front assembly of claim 4 wherein said elongated members and said corner connector members are circular in crosssection.

7. The front assembly of claim 4 wherein said elongated members and said corner connector members are rectangular in cross-section.

8. The front assembly of claim 1 wherein said corner connector members are elbow-shaped.

9. The front assembly of claim 1 wherein said support assembly includes a rigid bar fastened atop said elongated members for securing said shadow mask thereto, said rigid bar effectively extending continuously across the tops of said corner connector members.

10. The front assembly of claim 1 wherein said elongated members have ridge means along the top thereof for securing said shadow mask thereto, said corner connector members likewise having ridge means forming, effectively, a continuation of said ridge means of said elongated members.

11. A front assembly for a color cathode ray tube including a faceplate having on its inner surface a centrally disposed phosphor screen surrounded by a peripheral area adapted to mate with a funnel, said assembly including a shadow mask support structure for securing a shadow mask in tension on the structure and spacing said shadow mask from said screen, the support structure comprising a support assembly including a plurality of elongated members substantially surrounding the centrally disposed phosphor screen and meeting at corner areas of the screen, said elongated members having open ends, and corner connector members having reduced end portions sized and shaped in a plug format complementary to said open ends of adjacent ones of said elongated members for projecting into said open ends of said adjacent elongated members, said corner connector members, except for said plug portions thereof, being sized and shaped to form a continuation of the cross-sectional configuration of said elongated members.

12. The front assembly of claim 11 wherein said plug portions of each said corner connector member are sized to provide a snug fit with said open ends of the adjacent ones of said elongated members.

13. The front assembly of claim 11, including weld or braze means for securing and sealing said corner connector members to adjacent ones of said elongated members.

14. The front assembly of claim 13 wherein said weld or braze means are located between said plug portions of said corner connector members and said open ends of said elongated members.

15. The front assembly of claim 11 wherein said elongated members and said corner connector members are triangular in cross-section.

16. The front assembly of claim 11 wherein said elongated members and said corner connector members are circular in crosssection.

17. The front assembly of claim 11 wherein said elongated members and said corner connector members are rectangular in cross-section.

18. The front assembly of claim11 wherein said corner connector members are elbow-shaped.

19. The front assembly of claim 11 wherein said support assembly includes a rigid bar fastened atop said elongated members for securing said shadow mask thereto, said rigid bar effectively extending continuously across the tops of said corner connector members.

20. The front assembly of claim 11 wherein said elongated members have ridge means along the top thereof for securing said shadow mask thereto, said corner connector members having ridge means forming effectively, a continuation of said ridge means of said elongated members.

21. A front assembly for a color cathode ray tube including a faceplate having on its inner surface a centrally disposed phosphor screen surrounded by a peripheral area adapted to mate with a funnel, said assembly including a shadow mask support structure for securing a shadow mask in tension on the structure and spacing said shadow mask from said screen, the support structure comprising a support assembly including a plurality of elongated members substantially surrounding said phosphor screen and having substantially hollow ends meeting at corner areas of said screen, and elbow-shaped corner connector members for interfacing with and sealing the hollow ends of adjacent ones of said elongated members at the corner areas of said screen, said corner connector members being sized and shaped to form a smooth continuation of the cross-sectional configuration of said elongated members.

22. The front assembly of claim 21, including weld or braze means for securing and sealing said corner connector members to adjacent ones of said elongated members.

* * * * *